United States Patent [19]

Buhler

[11] Patent Number: 4,951,424

[45] Date of Patent: Aug. 28, 1990

[54] MACHINE FOR THE GRINDING OF RAILS

[75] Inventor: Fritz Buhler, Ecublens, Switzerland

[73] Assignee: Les Fils d'Auguste Scheuchzer S.A., Switzerland

[21] Appl. No.: 352,133

[22] Filed: May 15, 1989

[30] Foreign Application Priority Data

May 30, 1988 [EP] European Pat. Off. ..... 88810348.8

[51] Int. Cl.[5] ..... E01B 31/17

[52] U.S. Cl. ..... 51/178

[58] Field of Search ..... 51/178, 170 R, 241 LG, 51/241 R

[56] References Cited

U.S. PATENT DOCUMENTS 4,347,688 9/1982 Scheuchzer et al. ..... 51/178

FOREIGN PATENT DOCUMENTS 0315704 5/1989 European Pat. Off. ..... 51/178
2843649 4/1979 Fed. Rep. of Germany ..... 51/178
0616186 3/1980 Switzerland ..... 51/178

*Primary Examiner*—Roscoe V. Parker

*Attorney, Agent, or Firm*—Kane, Dalsimer, Sullivan, Kurucz, Levy, Eisele and Richard

[57] ABSTRACT

The carriage comprises a frame (10) with two end axles (10A, 10B), between which is located a bissel truck (10C, 16), the chassis (16) of which is articulated on one of these end axles (10A), and a guide bar (18) articulated between the axle (10C) of the bissel truck and the other end axle (10B). At least one wheel (C) of the bissel truck functions as a rail tracer. Grinding heads (T1, T2; T5, T6) are articulated on this chassis (16) and on this guide bar (18) by means of connecting rods (S1, S2; S5, S6) and are thus guided independently of the positions of the end axles, in such a way that the contact point of each grinding wheel (M1, M2; M5, M6) follows the rails independently of curves, thus compensating the cambers at these points. The carriage can have several successive bissel trucks articulated on one another, each guiding grinding heads, or a system of levers for the indirect guidance of the grinding heads, this system being controlled by a bissel measuring truck. To compensate the variation of the rails, telescopic bissel trucks can be provided.

18 Claims, 7 Drawing Sheets

Fig.12
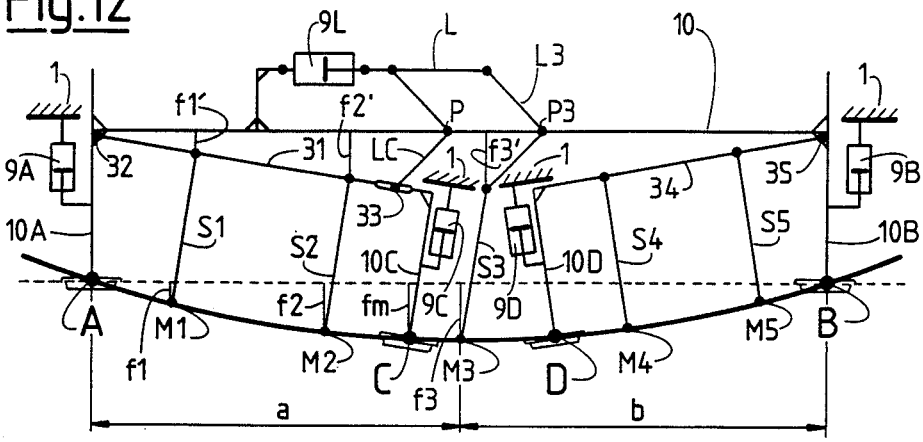
Fig.13
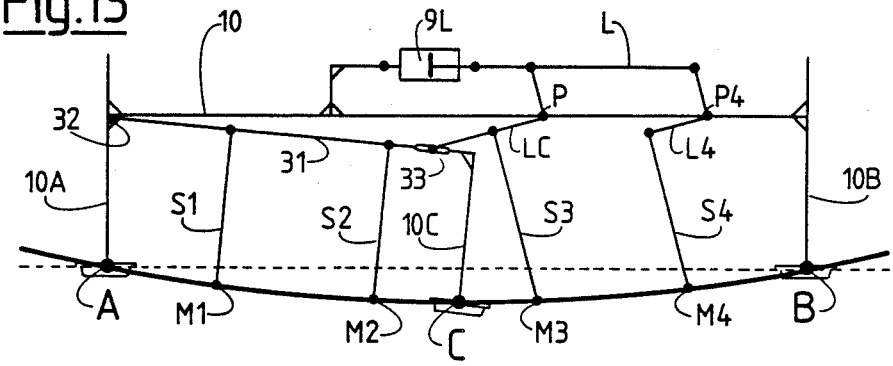
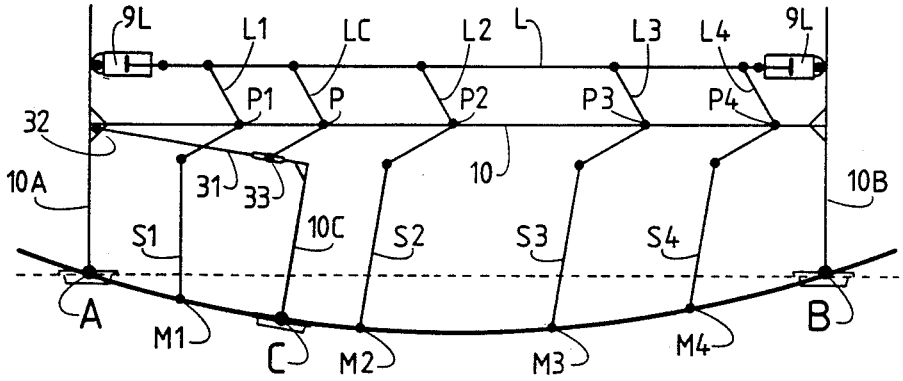
Fig.14

MACHINE FOR THE GRINDING OF RAILS

FIELD OF THE INVENTION

The present invention relates to a machine for the grinding of rails, which is equipped with at least one carriage guided by at least one rail line and provided with two end axles and with at least one grinding head for each rail line, each grinding head having at least one peripheral grinding wheel and being installed adjustably between the two end axles.

PRIOR ART

A grinding machine of this type is known from the Applicant's Patent No. DE-C-2,843,649, making it possible to eliminate the corrugations and the reprofiling of rails, and also from the Applicant's European Patent Application No. EP-A-87116468.7, allowing the reprofiling of the rail heads, this machine being equipped with at least one grinding head for each rail line, which is vertically displaceable by mean of at least one lifting device.

FIGS. 1 to 3 illustrate the known state of the art by way of example.

FIG. 1 shows a known grinding machine from the abovementioned European Patent Application No. EP-A-87116468.7, formed from a grinding vehicle 1 with two axles 2 which is movable on the track R and which is provided with a grinding carriage 3 equipped with grinding heads T having grinding wheels M. This grinding carriage 3 is suspended on the chassis of the vehicle 1 by means of jacks 4, so as to be movable relative to the vehicle 1, to be capable of taking the curves and to be lifted during light running.

As shown in FIG. 2, which is a diagrammatic view of the top of the lower part of the carriage 3 on a larger scale, the latter is supported by two axles 10A, 10B equipped with respective wheels A, A' and B, B' and connected by means of a frame 10 and, on each rail line R1, R2, has four grinding heads T, each supporting a peripheral grinding wheel M1, M2, M3, M4 and M5, M6, M7, M8 respectively. Each grinding head T is suspended in a frame 10 in an articulated manner about a horizontal axis 7 and about a vertical axis 8; each head can be lifted about the horizontal axis 7, independently of the others, by means of jack 5 which is shown diagrammatically in FIG. 1 and the upper end of which is articulated on the frame 10 of the carriage. Moreover, each grinding head is connected to the frame 10 of the carriage 3 by means of a connecting rod S which is articulated on the frame 10 at 6 and on the structure of the grinding head T at 6'. These connecting rods are adjustable to specific lengths and guide the grinding wheels. The two axles 10A, 10B of the carriage are pressed against the inner face of one of the rail lines, in this particular case the rail R1, by means of hydraulic jacks 9 supported by an abutment of the chassis of the vehicle 1. The adjustable suspension of the grinding heads can be that described in the Applicant's Patent No. DE-C-2,843,649.

The grinding wheels are positioned on the straight line defined by the respective wheels A, B and A', B' of the carriage 3 located on the same side, and their contact point with the rails is defined by the points C1 to C4 (FIG. 3). In the curves, the grinding wheels are maintained on the straight line between the said wheels, thus causing a lateral shift f1, f2, f3, f4 of the true contact point C1 to C4 of the grinding wheels in relation to the desired points C'l to C'4 along the axis of the rail line. This shift, or camber, is a function of the radius of curvature and of the position of the grinding wheel in relation to the ends of the arc between A and B. During working, the grinding wheels assume the conjugate profile of the rails, this profile changing according to the values of the camber in the curves; consequently, the grinding wheels have to change their profile at every entry and exit of the curves, thus causing a change in the profile of the rail in the transition zones.

In order to guarantee the correct profiling of the rails, the grinding heads and the grinding wheels respectively must be guided as a function of the curvature of the track.

SUMMARY OF THE INVENTION

The object of the present invention is to provide a grinding machine making it possible to guide the grinding wheels as a function of the curve of the track and thereby at least approximately compensate the cambers of the rails.

The advantages of the invention arise because a rail tracer installed between the axles controls the movable positioning members guiding the grinding heads in the transverse direction, so that the cambers at the contact point of each grinding wheel with the rail are at least approximately compensated.

BRIEF DESCRIPTION OF THE DRAWINGS

The invention will be described in more detail by means of the drawings.

FIGS. 12 to 14 show diagrammatic views of three other embodiments of the invention, comprising a measuring chassis and a system for the indirect guidance of the grinding heads, the said grinding heads and their positioning members being shown only for one of the rail lines.

DESCRIPTION OF THE PREFERRED EMBODIMENTS

Figure 1:
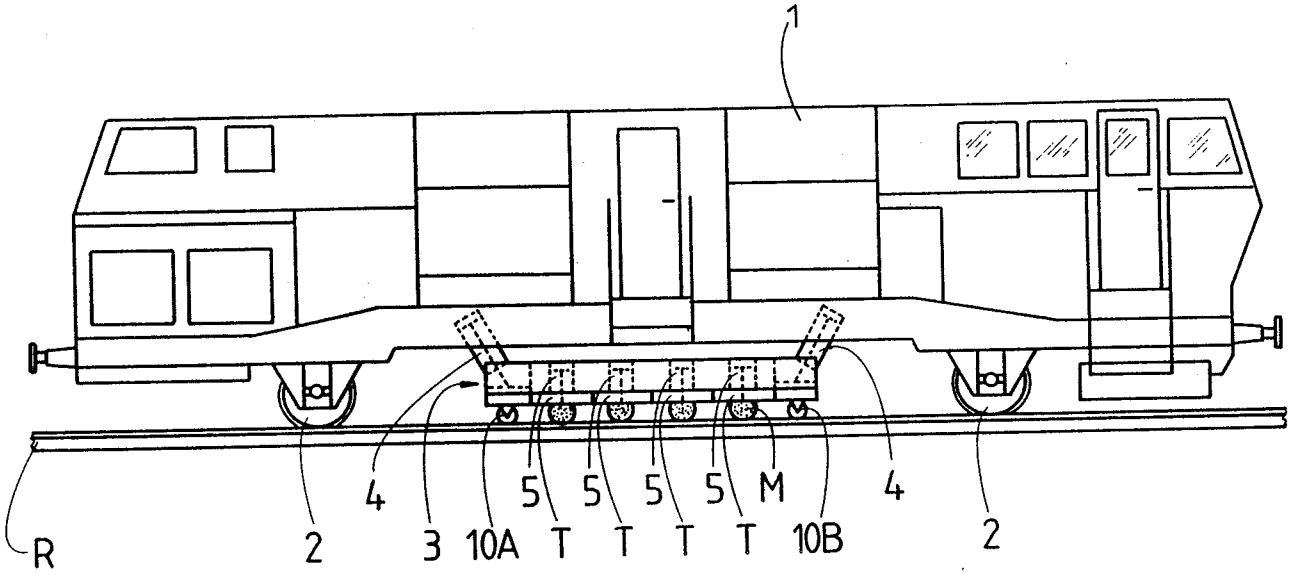
Fig.1 PRIOR ART
FIG. 1 is a side view of a grinding machine equipped with a grinding carriage carrying 4 grinding heads for each rail line with peripheral grinding wheels and illustrating the prior art.
Figure 2:
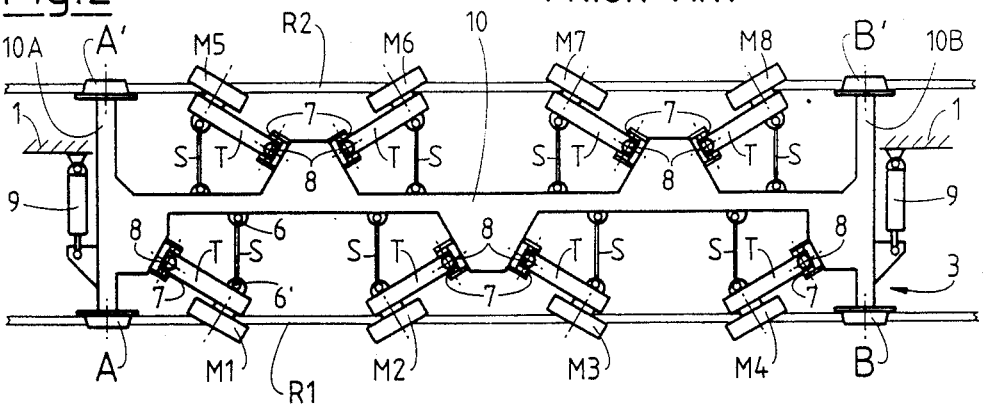
Fig.2 PRIOR ART
FIG. 2 a top view of a grinding carriage corresponding to the preceding FIGURE.
Figure 3:
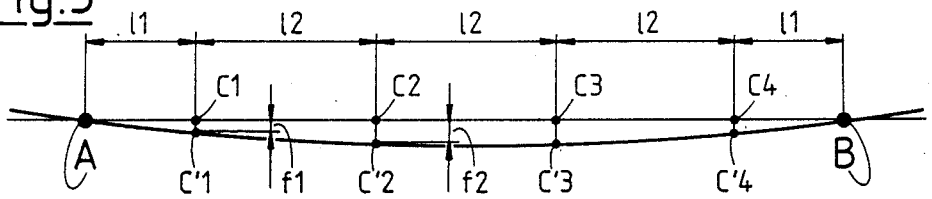
Fig.3 PRIOR ART
FIG. 3 a diagrammatic view showing the arc of a rail in a curve and the lateral shift of the contact point of the grinding wheels with the rail in relation to the straight line.

FIGS. 1 to 3 illustrating the prior art have already been described previously.

Figure 4:
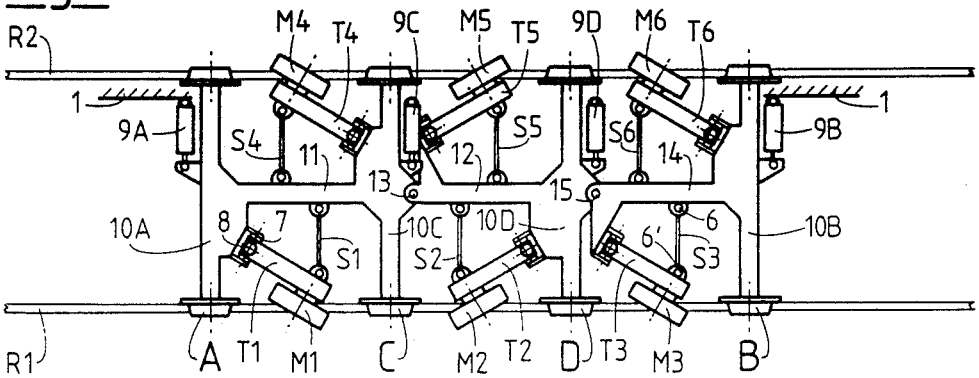
FIG. 4 shows a diagrammatic top view of a grinding carriage according to a first embodiment of the invention.

FIG. 4 shows a simplified first embodiment of a grinding carriage according to the invention. It is composed of a first chassis 11 with two axles 10A and 10C, equipped with wheels A, C, having the form of a short carriage and followed by a second chassis 12 with a single axle 10D equipped with wheels D and articulated on the first chassis 11 at the point 13, and by another chassis 14 with one axle 10B equipped with wheels B and articulated on the second chassis 12 at the point 15. The single-axle chassis 12 and 14 are so-called bissel trucks consisting of an axle 10D and 10B, the chassis of which has the form of a tail extending from the middle of the axle towards one side only. The end of this tail forms the point of articulation. In all the embodiments which will be described, the single-axle chassis are bissel trucks, to which reference will be made in the rest of the description.

The wheels C and D of the intermediate axles 10C and 10D are intended to function as tracers which follow the rail. In the region of the axles 10A, 10B, 10C, 10D, each of the chassis is pressed against the inner face of the rail R1 by means of hydraulic jacks 9A to 9D which at their other end are connected to the chassis 1 of the grinding vehicle.

In the example shown, each chassis of the grinding carriage possesses, on each side, a grinding head carrying peripheral grinding wheels M1 to M6, namely the grinding heads T1 to T3 with the grinding wheels M1 to M3 for the rail R1 and the grinding heads T4 to T6 with the grinding wheels M4 to M6 for the rail R2. As illustrated in FIG. 4, each grinding head is articulated on the corresponding chassis about a horizontal axis 7 and about a vertical axis 8, allowing the lifting and positioning of each head in the transverse direction. Each grinding head is guided by a connecting guide rod S1, S2, S3, S4, S5, S6, one end of which is articulated on the head at 6', whilst the other end is articulated on the corresponding chassis at 6. The connecting rods can be adjusted to a desired length.

If the construction of the carriage of FIG. 4 is compared with that of FIG. 2, it can be seen that the length of the chords of the arcs in the curves, within which the grinding wheels work, is smaller for the carriage of FIG. 4 than for that of FIG. 2, the effect of this being to automatically reduce the lateral shift of the contact points of the grinding wheels with the rails.

By way of example, shown in FIG. 3, for an arc of a radius of 250 m, using a carriage like that of FIG. 2, the total length of which is 320 cm between the wheels A and B, and by arranging the grinding wheels in such a way that the contact points C1, C2, C3, C4 with a rail in a straight line are at distances l1 and l2, with l1 equal to 400 mm and l2 equal to 800 mm, the lateral shift of the contact points of the corresponding grinding wheels in a curve is then approximately 2 mm for the grinding wheels M1 and M4 and approximately 5 mm for the grinding wheels M2 and M3.

Figure 5:
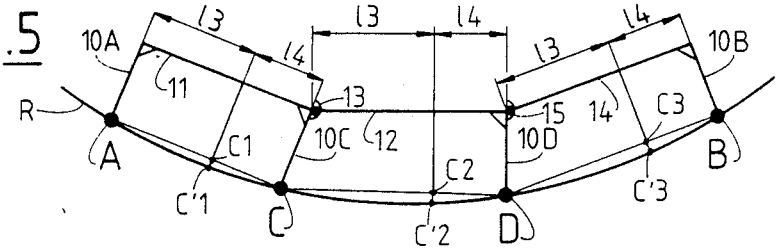
FIG. 5 is a view illustrating the functioning of the embodiment according to FIG. 4.

Referring now to FIG. 5 which illustrates diagrammatically the functioning of the carriage of FIG. 4, shown only in relation to one rail line, in this particular case the line R1, it will be seen that, on the curve A, B defined by the two wheels A and B of the two end axles 10A, 10B, the three articulated chassis of the carriage follow the said curve more closely. If, for example, the length of the chassis 11, 12 and 13 is set at 800 mm and the grinding wheels are arranged in such a way that the distances l3 and l4 of the contact points C1, C2 and C3 in relation to the adjacent front and rear wheels A, C and C, D and D, B, measured on straight rails, are l3 = 500 mm and l4 = 300 mm, then the shift of the contact points C1, C2, C3 in relation to the desired points C'l, C'2, C'3 along the axis of the rail line is this time of the order of 0.3 mm. With the proposed carriage, therefore, there is a marked reduction in the lateral shift of the grinding wheels in a curve.

Figure 6:
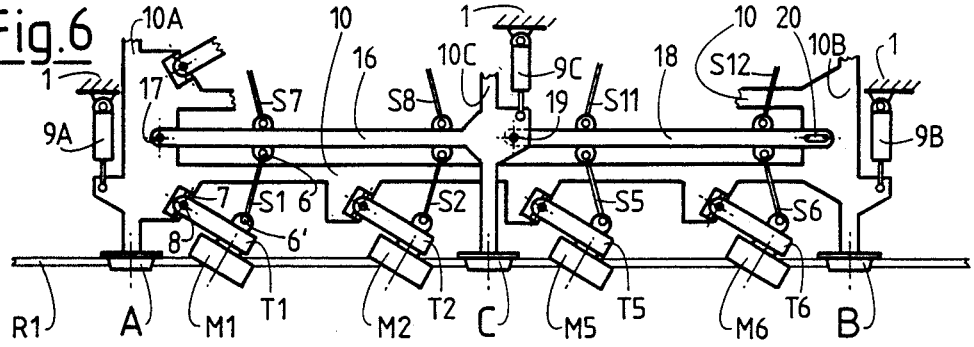
FIG. 6 is a partial diagrammatic view of a second embodiment of the invention, showing only the grinding heads and their positioning members for one of the rail lines.

FIG. 6 illustrates an embodiment of higher capacity of the invention. Only the longitudinal half of the carriage interacting with the rail R1 has been shown, the other half interacting with the rail R2 being of the same construction.

According to this embodiment, the carriage is composed of two end axles 10A, 10B with the wheels A and B, connected by means of a frame 10, of a bissel truck formed from an axle 10C equipped with the wheels C and from a chassis 16, and of a guide bar 18. The end of the chassis 16 is articulated at 17 on the axle 10A, and therefore on the corresponding end of the frame 10, and the guide bar 18 is articulated between the axle 10C of the bissel truck at the point 19 and the axle 10B at the point 20, and therefore on the other end of the frame 10. The point of articulation 20 is displaceable in an oblong hole in order to compensate the variation in the distance between the axles 10C and 10B in a curve.

The bissel truck with its chassis 16 guides, on each side, two grinding heads, of which FIG. 6 illustrates only those interacting with the rail R1, namely the grinding heads T1, T2 with the grinding wheels M1, M2. This guidance takes place by means of the connecting rods S1 and S2 articulated at 6 on the chassis 16 and at 6' on the corresponding grinding head which, as in the preceding embodiments, can rotate about the vertical axis 8 and the horizontal axis 7 located in the frame 10. Only the connecting rods S7 and S8 have been shown for the other symmetrical side.

In the same way, on each side the guide bar 18 guides two grinding heads, of which FIG. 6 illustrates only those interacting with the rail R1, namely the grinding heads T5, T6 with the grinding wheels M5, M6 connected to the said bar 18 by means of the articulating connecting rods S5, S6. The grinding wheels located on the other side are represented only by the connecting rods S11 and S12. The three axles and the bissel truck and guide bar 18 are pressed against the rail R1 by means of jacks 9A, 9B, 9C which bear against the chassis of the vehicle 1, the wheel C on the rail line R1 forming the tracer which follows this rail line.

Figure 7:
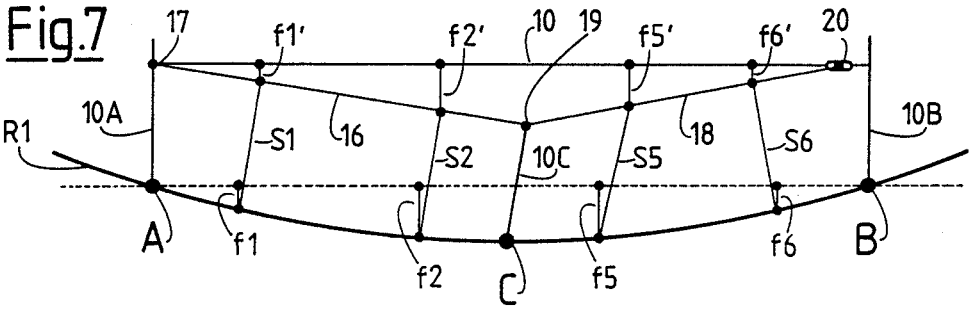
FIG. 7 is a view illustrating the functioning of the embodiment according to FIG. 6.

FIG. 7 illustrates the functioning of the carriage of FIG. 6 in a curve A, B. The dimensions and arrangement of the connecting rods S1, S2, etc. are such that, if the axle 10C is shifted transversely, the shift of the chassis 16 of the bissel truck and of the guide bar 18 in relation to the frame 10 for the distance f1', f2', f5', f6' at the points of articulation of the connecting rods positions the grinding wheels M1, M2, etc., by causing the grinding heads T1, T2, etc. to pivot about their vertical axis 8 in the transverse direction over a distance compensating the cambers f1, f2, f5, f6 at the contact points with the rail R1. The carriage illustrated in FIG. 6 achieves a good result with a single intermediate axle.

Figure 8:
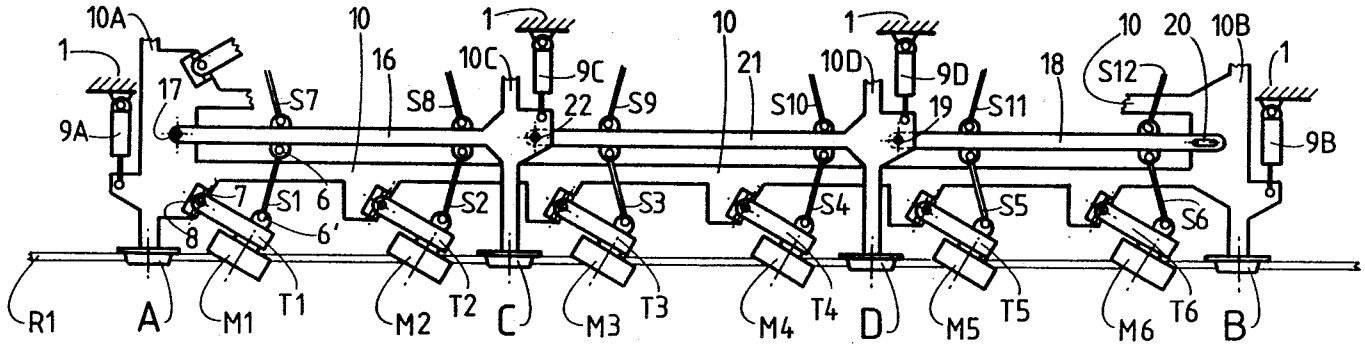
FIG. 8 is an extended alternative version of the second embodiment according to FIG. 6.

The embodiment of the carriage according to FIG. 8 differs from that of FIG. 6 in that there is a second bissel truck comprising an axle 10D, with the wheels D, and a chassis 21, this second bissel truck being inserted between the first bissel truck, with the axle 10C and chassis 16, and the guide bar 18. The chassis 21 of this second bissel truck is articulated on the axle 10C of the first bissel truck at 22, whilst the guide bar 18 is articulated on the axle 10D at 19.

The chassis 21 of the second bissel truck, in the middle of the carriage, also guides two grinding heads on each side; only those interacting with the rail R1 have been shown, namely the grinding heads T3, T4 with the grinding wheels M3, M4 guided by means of articulating connecting rods S3, S4; only the connecting rods S9 and S10 being shown as an element belonging to the second side. A jack 9D fastened to the chassis 1 of the vehicle likewise presses the axle 10D against the rail R1, the wheels C and D functioning as tracers.

All the other elements of the carriage comprising the end axles, the first bissel truck, the guide bar and the other positioning members for the grinding wheels are the same as those of the embodiment according to FIG. 6 and bear the same references. As shown, six grinding heads for each rail line can easily be guided by means of this carriage equipped with two intermediate axles 10C, 10D, the wheels C and D of which form the tracers.

Figure 9:
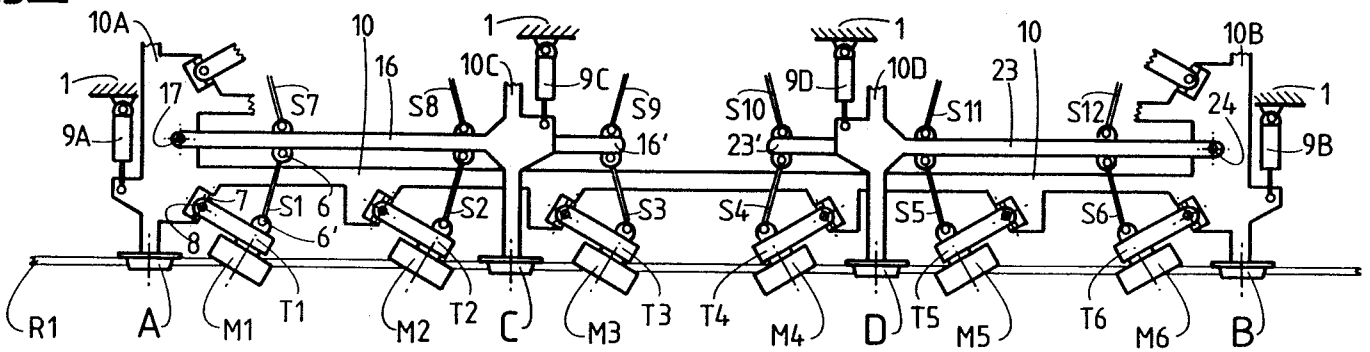
FIG. 9 is a partial diagrammatic view of a third embodiment of the invention.

The carriage according to the embodiment illustrated in FIG. 9 comprises two end axles, namely the axle 10A with the wheels A and the axle 10B with the wheels B, which are connected to the common frame 10. In this instance, articulated on each end axle is a bissel truck, one formed from the axle 10C with the wheels C and from the chassis 16 articulated on the axle 10A at 17, and the other formed from the axle 10D with the wheels D and from the chassis 23 articulated on the end axle 10B at 24. The two bissel trucks are therefore reversed relative to one another and are not connected together. In contrast, in the extension of each chassis 16 and 23 there is a cantilevered part 16' and 23', guiding a grinding head on each side by means of connecting rods S3, S4 and S9, S10; only the grinding heads T3 and T4 with the respective grinding wheels M3 and M4 interacting with the rail R1 are shown.

This embodiment affords the possibility of having, on each side, not only two grinding heads inside the bissel truck, namely the grinding heads T1, T2 and T5, T6, but also, on each side, an additional grinding head T3 and T4 located outside the bissel truck. Thus, with this embodiment, at least three grinding wheels can be guided on each side by means of a single bissel truck, both on the inside and on the outside of the actual bissel truck. As in the preceding embodiments, jacks 9A to 9D fastened to the chassis 1 of the vehicle press the axles 10A to 10D against the rail R1, the wheels C, D of the intermediate axles forming the tracers.

Figure 10:
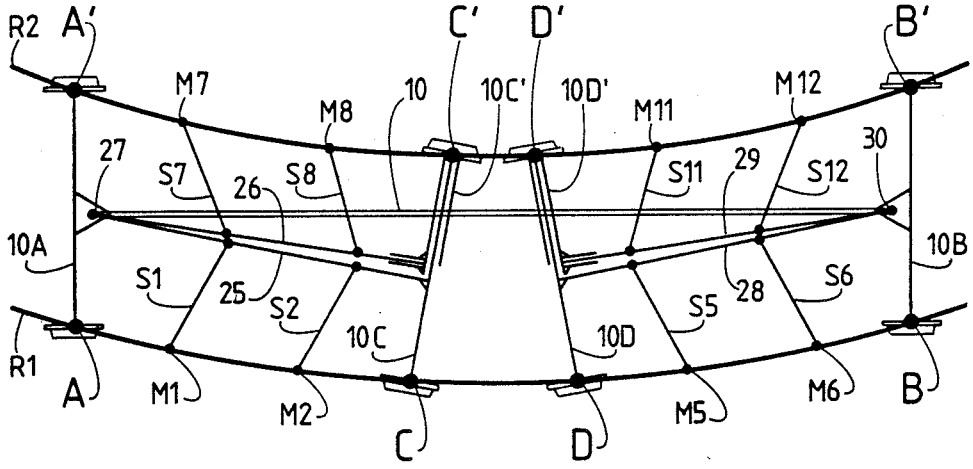
FIG. 10 is a diagrammatic view illustrating a fourth embodiment of the invention, in which the intermediate axles and their chassis are telescopic, the grinding heads merely being symbolized by the contact points of the grinding wheels on the rails.

FIG. 10 shows an embodiment of a carriage which compensates for variation in the rail gage. This carriage is shown diagrammatically, the grinding heads merely being symbolized by the contact points of the grinding wheels M1, M2, etc. with the rail, all the other details being omitted. This embodiment in general resembles that of FIG. 9, with two bissel trucks arranged in reversed fashion between the two end axles 10A, 10B, with the wheels A, A' and B, B', connected by means of the frame 10. However, each bissel truck is formed from two parts telescopically in the transverse direction, one for each rail R1, R2. The first bissel truck has one part composed of a half-chassis 25 fastened to the section 10C of its telescopic axle with the wheel C, and another part composed of a half-chassis 26 fastened to the section 10C' of its axle with the wheel C'. Likewise, the second bissel truck has one part composed of a half-chassis 28 fastened to the section 10D of its telescopic axle with the wheel D and another part composed of a half-chassis 29 fastened to the section 10D' of its axle with the wheel D'. The parts 25, 26 of the chassis of the first bissel truck are articulated at their ends on the axle 10A at the point 27, and the parts 28, 29 of the chassis of the second bissel truck are articulated at their ends on the axle 10B at the point 30. The two parts of each bissel truck are spaceable from one another and are subjected to a spacing force which is such that the wheels C, C' and D, D' forming independent tracers on the two sides of each axle are pressed against the rail lines R1, R2. Each chassis part guides the grinding wheels M1, M2, M5, M6 by means of the respective connecting rods S1, S2 and S5, S6 and the grinding wheels M7, M8, M11, M12 by means of the respective connecting rods S7, S8 and S11, S12, independently for each rail line.

Because the curvature of the rail is exaggerated in FIG. 10, the inclined position of the intermediate axles with the wheels C and D is likewise exaggerated.

Figure 11:
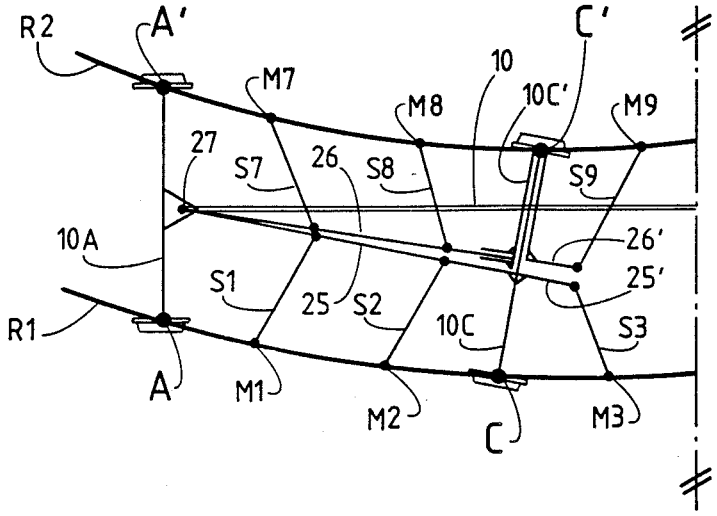
FIG. 11 is an alternative version of the embodiment according to FIG. 10 and corresponds to half of this, but in it the chassis of a carriage also possesses cantilevered grinding heads.

FIG. 11, although illustrating an alternative version of the embodiment according to FIG. 10, shows only one of these bissel trucks, namely that articulated on the axle 10A, with the parts 25, 26 of the chassis and the sections 10C and 10C' of the axle. In addition to the elements described with reference to FIG. 10, there is a cantilevered part 25', 26' located beyond the two parts 10C, 10C' of the telescopic axle and in the extension of the parts 25, 26 of the chassis and allowing an additional grinding wheel M3, M9 for each rail line to be guided by means of the connecting rods S3, S9.

The construction of the bissel trucks and of the chassis and of the axles in two parts can, of course, be of any type other than that shown in FIGS. 10 and 11. It is also possible for the chassis of the embodiments according to FIGS. 4 to 9 likewise to be made into spaceable parts, in which case the guide bar 18 according to FIG. 6 is also duplicated.

In the embodiments just described, the grinding heads are guided directly by the bissel trucks or by the chassis or by the guide bar.

FIGS. 12 to 14 show embodiments in which the carriage possesses a system for the indirect guidance of the grinding heads, this system being controlled by a bissel measuring truck. These FIGURES once again show only one longitudinal half of the carriage associated with one of the rail lines.

In the three FIGURES, the end axles 10A, 10B with the wheels A, B are connected by means of a frame 10, as in the preceding embodiments.

According to the embodiment of FIG. 12, there is a first bissel truck formed from an axle 10C with wheels C acting as tracers and from a chassis 31 which is articulated on the end axle 10A at the point 32. This bissel truck functions as a bissel measuring truck and guides a system of levers. This system comprises a bent control lever LC which is articulated at one of its ends o the chassis 31 at 33 and the bend of which is articulated on the frame 10 at the point P, a bent guide lever L3 which is articulated at one of its ends on a connecting rod S3 and the bend of which is likewise articulated on the frame 10 at the point P3, and a bar L pivotably connecting the other two ends of these two levers LC and L3. The guide lever L3 guides the grinding head with a grinding wheel M3 by means of the connecting rod S3.

In this embodiment, the chassis 31 of the bissel measuring truck also guides two grinding heads with grinding wheels M1, M2 directly by means of connecting rods S1, S2. A second bissel truck formed from an axle 10D with wheels D acting as tracers and from a chassis 34 articulated on the end axle 10B at the point 35 also directly guides two grinding heads with grinding wheels M3, M4 by means of connecting rods S3, S4.

As in the preceding embodiments, the four axles 10A, 10B, 10C, 10D are pressed against the rail by means of pneumatic or hydraulic jacks 9A, 9B, 9C, 9D, whilst the bar L of the lever system is prestressed, by means of the jack 9L bearing on an abutment of the frame 10, in the direction laying the wheels C, D against the rails, in order to prevent any play in the lever system. If the jack 9L is provided it is possible to do without the jack 9C.

In FIG. 13, the same bissel measuring truck consisting of an axle 10C with wheels C and of a chassis 31 controls a lever system also comprising two bent levers, namely a control lever LC and a guide lever L4, which are articulated on the frame 10 at the respective points P and P4 and which are connected by means of a common bar L. In this instance, however, the control lever LC serves at the same time as a guide lever guiding a grinding head with a grinding wheel M3 by means of a connecting rod S3, whilst the other lever L4 guides a grinding head with a grinding wheel M4 by means of a connecting rod S4. In contrast, in this embodiment no other bissel truck is provided.

According to the embodiment of FIG. 14, once again the carriage possesses a bissel truck formed from an axle 10C with wheels C serving as tracers and from a chassis 31 articulated on the end axle 10A at the point 32. In this instance, the chassis does not guide grinding heads directly, but instead the lever system comprises, in addition to the control lever LC, four guide levers L1, L2, L3, L4, each being articulated on the frame 10 at a point P1, P2, P3, P4 and being connected pivotably to the common bar L, these levers guiding four grinding heads with grinding wheels M1 to M4 by means of connecting rods S1 to S4. Because of the length of the common bar L, there are two jacks 9L which exert a prestress on the lever system in order to prevent the play of the said levers.

Of course, the carriages according to FIGS. 13 and 14 likewise have jacks which have not been shown and are similar to the jacks 9A, 9B according to FIG. 12 and which lay the end axles 10A, 10B against one of the rails.

At all events, the length and arrangement of all the levers are such that, in a curve, the bissel measuring truck which measures the camber at the location of the tracer shifts the grinding wheels as a result of the pivoting of the guide levers, in such a way that the cambers at the contact points of these grinding wheels with the rail are compensated. In fact, by means of the common bar L, all the guide levers execute a synchronous movement controlled as a function of the movement of the control lever LC.

In FIG. 12, a curve shows the transverse shift fm, representing the camber, of the tracer C which follows the rail. This shift of the tracer results accordingly in the respective transverse shift f1', f2' and f3' at the end of the connecting rod S1 and S2 and of the guide lever L3 in relation to the frame 10, thereby compensating the camber f1, f2 and f3 at the contact point of the respective grinding wheel M1, M2 and M3 with the rail. Moreover, to determine the length of the connecting rods and of the levers, the known approximation equation $f=a\times b/2r$ can be used, with f being the distance of a point on a chord to the arc A B, a and b being the distances of the said point at the ends of the chord, and r being the radius of curvature of the rail. FIG. 12 shows the distances a, b for the contact point of the grinding wheel M3 where the distance f is the camber f3.

Figure 15:
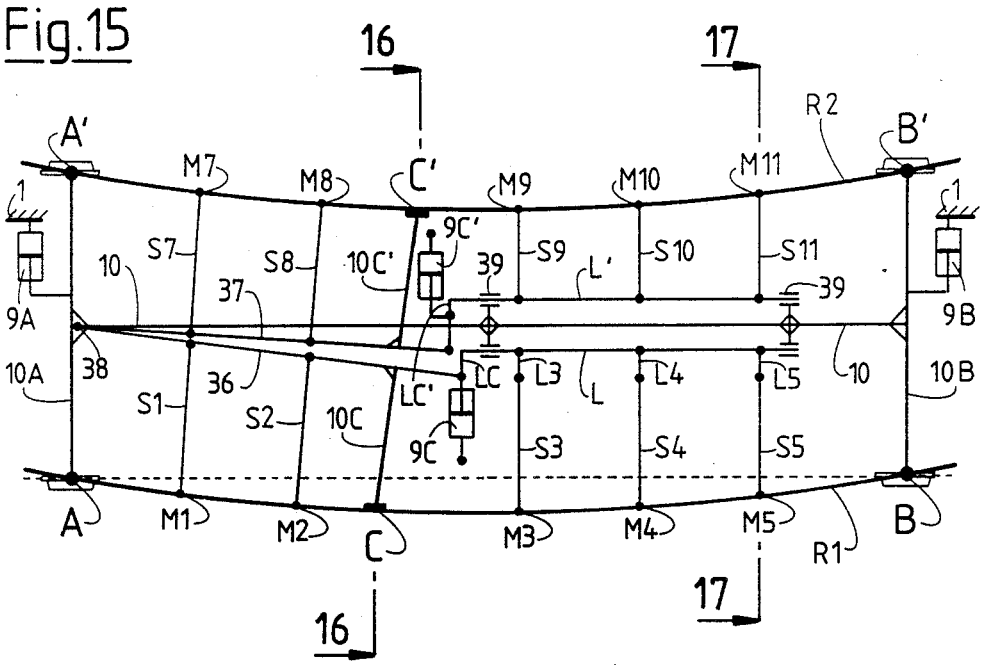
FIGS. 15 to 17 an embodiment similar to those of FIGS. 12 to 14, with the measuring chassis and the guide system in two parts.
Figure 16:
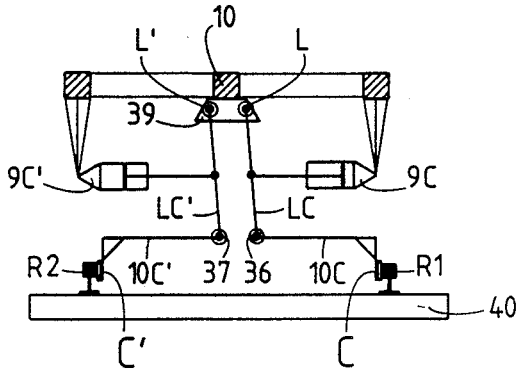
Figure 17:
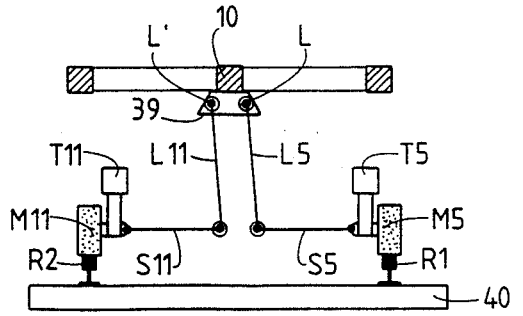

The embodiment illustrated in FIGS. 15 to 17, of which FIG. 16 shows a cross-section along the line XVI-XVI of FIG. 15 and FIG. 17 shows a cross-section along the line XVII-XVII of FIG. 15, has a carriage with indirect guidance of the grinding wheels, which is similar to the carriage shown in FIGS. 12 to 14, but this time the two parts of the bissel measuring truck and positioning members, one part for each rail R1, R2, are illustrated. The configuration of the lever system has also been changed in relation to that shown in FIGS. 12 to 14.

According to this embodiment, there are likewise two end axles 10A, 10B with the wheels A, A', B, B' on the rails R1 and R2, and the two end axles are connected by means of the frame 10. The bissel measuring truck is in two parts, namely a bissel half-truck comprising the chassis 36 and the half-axle 10C and a bissel half-truck comprising the chassis 37 and the half-axle 10C', the two chassis being articulated on the end axle 10A at 38. In this embodiment, the tracers used are not wheels, but sliding tracers which are pressed against the rails R1, R2 by means for spacing the half-axles 10C, 10C', these means being formed by two jacks 9C, 9C' which will be described later.

Each chassis 36, 37 guides the respective grinding wheels M1, M2 and M7, M8 directly by means of the connecting S1, S2 and S7, S8.

Articulated on each chassis 36 and 37 is a control lever LC and LC' which, in this embodiment, extends essentially in the vertical direction, as shown in FIGS. 16 and 17. The other end of the lever LC is fastened to a common bar L, whilst the other end of the lever LC' is fastened to a common bar L'. According to this embodiment, these two bars L, L' are parallel rotary shafts which extend longitudinally and which are seated pivotably in bearings 39 of the frame 10. Fastened respectively to each bar L and L' are three guide levers, namely the levers L3, L4, L5 on the bar L for one of the sides and three other levers, not visible in FIG. 15, on the bar L' for the other side. In the cross-section according to FIG. 17, only the guide lever L11 can be seen. As in the preceding embodiments, a connecting rod S3 to S5 on one side and S9 to S11 on the other side is articulated on the other end of each guide lever and guides the grinding wheels M3 to M5 on the rail R1 and M9 to M11 on the rail R2.

The two bissel half-trucks are spaced from one another by means of a jack 9C for the chassis 36 and a jack 9C' for the chassis 37, as illustrated particularly in FIG.

16 which shows that these jacks are articulated on the control levers LC, LC' and bear against abutments of the frame 10. There could also be a single double-acting jack between the two spaced bissel half-trucks. Of course, the end axles 10A, 10B are laid against the rail R1 by means of jacks 9A, 9B.

In this embodiment, the control levers LC, LC' serve at the same time for suspending the bissel half-trucks on the frame 10. The length of the guide levers is selected so that, in the curves, the cambers at the locations of the contact points of the grinding wheels with the rail are compensated. These guide levers likewise execute a synchronous movement, that is to say rotate in synchronism with the rotary shaft L or L' about the axis of this shaft which will itself be rotated by means of the control lever LC or LC' as a function of the stroke of the tracer C, C'.

In all the embodiments described, the example where the end axles 10A, 10B are laid against a single rail by means of a jack has been considered. Of course, in order to compensate the variation of the rail gage, it is possible to have a telescopic end axle in two parts which are spaced in such a way that the two wheels are laid against the two rails. The same measure can also be used for all the intermediate axles according to FIGS. 4, 6, 8 and 9.

Furthermore, in the embodiments according to FIGS. 9, 10 and 12, where there are two reversed bissel trucks, each articulated on one of the end axles, these two bissel trucks can be connected by means of a guide bar, such as the guide bar 18 according to FIG. 6, which would be articulated on each axle of the bissel truck and which would serve as a support for connecting rods carrying additional grinding wheels, in which case there would, of course, be no need for the cantilevered sections according to the FIG. 9.

Figure 18:
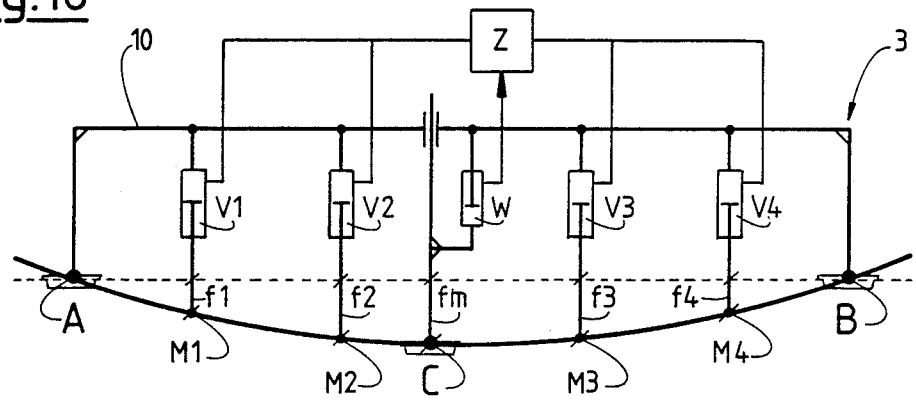
FIG. 18 shows an embodiment which uses as a positioning member jacks controlled by a tracer by means of an arithmetic unit.

Finally, FIG. 18 illustrates a last embodiment of a carriage comprising two axles 10A, 10B, with the wheels A, B, connected by means of a frame 10, a tracer C, in this case formed by a wheel and its axle, a system for measuring the transverse shift W of the tracer C, jacks V1 to V4 supported on one side by the frame 10 and actuating the positioning of the grinding heads with the grinding wheels M1 to M4, and a computer Z. In this example, the lateral shift fm of the tracer C is measured by means of the measuring system W, and the result is transmitted to the computer Z which, as a function of this measured camber fm, calculates the cambers f1 to f4 at the contact point of each grinding wheel M1 to M4 and controls the jacks V1 to V4 so that they position the grinding wheels in such a way that these cambers are compensated. This positioning of the grinding heads is carried out as a result of an integral measurement of their movements. An identical system is provided for the positioning of the grinding heads on the other rail, this second system being controllable by mean of the same tracer C or by means of a second tracer following the other rail.

The invention is not limited to the embodiments just described, but allows for many alternative versions. In particular, the tracers are not necessarily formed by the wheels of the intermediate axles, but any other type of tracer could be used, for example tracers sliding along the rail line. Likewise, the grinding carriage is not necessarily suspended underneath the vehicle, but there could be a carriage forming an independent unit which would be towed by the traction vehicle.

I claim:

1. A machine for the grinding of rails, which is equipped with at least one carriage (3) guided by at least one rail line and which is provided with two end axles (10A, 10B) connected by means of a frame (10) and with at least one grinding heat (T1 to T6) for each rail line (R1, R2), carrying at least one peripheral grinding wheel (M1 to M10) and installed adjustably between the two end axles (10A, 10B), said carriage being equipped with a system for guiding the grinding heads (T1 to T6), comprising at least one rail tracer (C) which is installed between the end axles and is displaceable in the transverse direction and which is designed to follow one of the rail lines (R1), and members for positioning the grinding heads (T1 to T6), these members consist of at least two successive articulated elements mounted between the end axles (10C) carrying the said tracers (C), the connection of said elements to the said frame (10) being only made, on one side, by means of a point of articulation (17, 27, 32) of a first element (16; 25, 26; 31) near one of the end axles (10A), and on the other side, by means of a point of articulation (20, 24, 30, 35) of a second element (18; 23; 28, 29; 34) near the other end axle (10B), at least one grinding head, preferably two grinding heads, for each rail line (R1, R2) being articulated on each element by means of connecting rods (S1 to S10), said members for positioning the grinding heads being controlled by the said tracer (C) and positioning the grinding heads (T1 to T6) in such a way that the contact point of each grinding wheel (M1 to M10) follows the rails independently of the curves.

2. A machine as claimed in claim 1, wherein the first element is a chassis (16) with one axle (10C), if appropriate followed by at least one other single-axle chassis (21) articulated on the preceding one and likewise guiding grinding heads by means of connecting rods (S3, S4), and wherein the second element is a guide bar (18), one end of which is articulated (20) on the frame (10) near the corresponding end axle (10B) and the other end of which is articulated on the adjacent single-axle chassis (16; 21), this guide bar (18) likewise guiding grinding heads by means of connecting rods (S5, S6) (FIGS. 6, 7 and 8).

3. A machine as claimed in claim 1, wherein the first element is a chassis (16; 25, 26; 31) with one axle (10C', if appropriate followed by at least one other single-axle chassis, this other chassis being articulated on the preceding one and likewise guiding grinding heads by means of connecting rods, and wherein the second element is also a chassis (23; 28, 29; 34) with one axle (10D) carrying tracers (D), if appropriate followed by at least one other chassis articulated on one axle and likewise guiding grinding heads by means of connecting rods (FIGS. 9, 10 and 12).

4. A machine as claimed in claim 3, wherein mounted between two adjacent single-axle chassis, the axles of which are opposite one another and which are articulated, on one side, on one of the end axles directly or by means of at least one other chassis and, on the other side, on the other end axle directly or by means of at least one other chassis, is a guide bar articulated at its two ends on the mutually opposite axles of the two adjacent chassis.

5. A machine as claimed in claim 3, wherein the said chassis (12, 14, 16, 23) with one axle (10C, 10D) is a bissel truck rolling on an axle of which the wheels (C, D) form the said tracers.

6. A machine as claimed in claim 5, wherein at least one chassis (16; 23; 25, 26) with one axle (10C, 10D) has a part (16', 23'; 25', 26') which extends in a cantilevered manner beyond the axle opposite the point of articulation, and wherein this cantilevered part guides at least one other grinding head by means of a connecting rod (S3, S4; S3, S9) (FIGS. 9 and 11).

7. A machine as claimed in claim 3, wherein, in order to compensate the variation of the rail gage, the positioning members comprising a chassis with one bar are divided into or provided in two parts, one for each rail, which are spaceable from one another in the transverse direction and which are subjected to a spacing force, so that the two tracers carried by the two parts of an axle, which are formed especially by their wheels, are laid against the two rail lines (R1, R2) guiding the grinding heads independently for each rail line.

8. A machine as claimed in claim 7, wherein the single-axle chassis or chassis are formed in two parts (25, 26, 10C, 10C'; 28, 29, 10D, 10D'; 36, 37, 10C, 10C'), especially with a telescopic axle, wherein the ends of the two parts of the chassis (25, 26; 28, 29; 36, 37) are articulated on the frame (10) respectively near one or the other of the end axles (10A, 10B), and wherein the other ends of these two parts having the intermediate axle or the intermediates axles (10C, 10C', 10D, 10D') are spaceable from one another.

9. A machine as claimed in claim 1, wherein each end axle (10A, 10B) is subjected to the action of a pressure device (9A, 9B), particularly pneumatic or hydraulic jacks, pressing the wheels (A, B) of each axle against one of the rail lines, or, in order to compensate the variation of the rail gage, it is in two parts spaceable from one another in the transverse direction and subjected to a spacing force, so that the two wheels (A, A', B, B') are laid against the two rail lines.

10. A machine as claimed in claim 1, wherein each intermediate axle (10C, 10D) is subjected to the action of a pressure device (9C, 9D), particularly pneumatic or hydraulic, pressing the tracer preferably formed by the wheel (C, D) against one of the rail lines.

11. A machine for the grinding of rails, which is equipped with at least one carriage (3) guided by at least one rail line and which is provided with two end axles (10A, 10B) connected by means of a frame (10) and with at least one grinding head (T1 to T6) for each rail line (R1, R2), carrying at least one peripheral grinding wheel (M1 to M10) and installed adjustably between the two end axles (10A, 10B), said carriage being equipped with a system for guiding the grinding heads (T1 to T6), comprising at least one rail tracer (C) which is installed between the end axles and is displaceable in the transverse direction and which is designed to follow one of the rail lines (R1), and members for positioning the grinding heads (T1 to T6), these members consist, on the one hand, of at least one chassis (31; 36, 37) with one axle (10C), functioning as a measuring chassis carrying at least one tracer (C) and articulated on the frame (10) near one of the end axles (10A) directly or by means of at least one other chassis articulated on one axle and consist, on the other hand, of a system of levers (LC, L. L1 to L5) for the indirect guidance of the grinding heads, this lever system being controlled by the said tracer (C), all the levers of this system having such a dimension that, as a result of the measurement of the camber (fm) of a curve by the measuring chassis at the location of the tracer (C), the cambers (f1, f2 . . . ) corresponding to the contact point of the grinding heads are compensated (FIGS. 12 to 15) said members for positioning the grinding heads being controlled by the said tracer (C) and positioning the grinding heads (T1 to T6) in such a way that the contact point of each grinding wheel (M1 to M10) follows the rails independently of the curves.

12. A machine as claimed in claim 11, wherein, in order to compensate the variation of the rail gauge, the positioning members comprising a chassis with one axle and said lever system with a common bar are divided into or provided in two parts, one for each rail, which are spaceable from one another in the transverse direction and which are subjected to a spacing force, so that the two tracers carried by the two parts of an axle, which are formed especially by their wheels, are laid against the two rail lines (R1, R2) guiding the grinding heads independently for each rail line.

13. A machine as claimed in claim 11, wherein the said lever system comprises a control lever (LC) and at least one guide lever (L1 to L4), and wherein all the levers are mounted pivotably (P, P1 to P4, 39) on the frame (10) and are connected by means of a common bar (L), so that all the guide levers execute a synchronous movement according to the movement of the said control lever (LC), one end of the control lever (LC) being articulated on the said single-axle chassis (10C), whilst one end of each guide lever (L1 to L4) is articulated on a connecting rod (S1 to S4), each guiding a grinding head (FIG. 14).

14. A machine as claimed in claim 13, wherein the common part (L, L,) is a longitudinal rotary shaft seated in the frame (10), and wherein the control lever (LC, LC,) and the guide levers fastened to the said rotary shaft are essentially of vertical orientation, the said control lever (LC, LC,) preferably serving at the same time for suspending the measuring chassis (36, 37) on the frame (10) (FIGS. 15 to 17).

15. A machine as claimed in claim 11, wherein at least one connecting rod (S1, S2) is also articulated on the single-axle chassis (31), for a direct guidance of the articulated grinding heads by means of these connecting rods (FIGS. 12, 13 and 15).

16. A machine as claimed in claim 11, wherein two single-axle chassis (31, 34) are articulated on the frame (10), each at each end of the latter and therefore near the two end axles (10A, 10B), each chassis guiding several grinding heads directly by means of the connecting rods (SI, S2; S4, S5), and wherein at least one of the chassis (31) also guides at least one other grinding head (M3) indirectly by means of a lever system (LC, L, L3) (FIG. 12).

17. A machine as claimed in claim 11, wherein the said lever system is subjected to a prestress in the direction laying the tracers against the rail in question, in order to reduce the play of the levers, this prestress preferably being generated by means of at least one pneumatic or hydraulic jack (9L) acting on the common bar (L) and bearing against an abutment of the frame (10) (FIGS. 12, 13 and 14).

18. A machine for the grinding of rails, which is equipped with at least one carriage (3) guided by at least one rail line and which is provided with two end axles (10A, 10B) and with at least one grinding head (T1 to T6) for each rail line (R1, R2), carrying at least one peripheral grinding wheel (M1 to M10) and installed adjustably between the two end axles (10A, 10B), wherein the carriage is equipped with a system for guiding the grinding heads (T1 to T6), comprising at least one rail tracer (C) which is installed between the end axles and is displaceable in the transverse direction and which is designed to follow one of the rail lines (R1), and members for positioning the grinding heads (T1 to T6), the said carriage (3) being equipped with a system for measuring the transverse shift (W) of the tracer or tracers (C) measuring the camber (fm), said members consist of jacks (V1 to V4) fastened to the frame (10) of the carriage and positioning grinding heads as a result of the integral measurement of their movements, and a computer (Z) which, as a function of the measured camber (fm), determines the cambers (f1 to f4) at the contact point of each grinding wheel (M1 to M4) and which controls the said jacks (V1 to V4) which position the grinding heads (T1 to T6) in such a way that the contact point of each grinding wheel (M1 to M10) follows the rails independently of the curves.

* * * * *